US005765684A

United States Patent [19]

Van Dore et al.

[11] Patent Number: 5,765,684

[45] Date of Patent: Jun. 16, 1998

[54] CONTAINER CARRIER

[75] Inventors: Jonathan Van Dore, Royal Oaks, Mich.; James A. Broskow, Buffalo Grove, Ill.

[73] Assignee: Illinois Tool Works Inc., Glenview, Ill.

[21] Appl. No.: 959,960

[22] Filed: Oct. 24, 1997

Related U.S. Application Data

[63] Continuation of Ser. No. 668,830, Jun. 24, 1996, abandoned.

[51] Int. Cl.[6] ..... B65D 71/00

[52] U.S. Cl. ..... 206/427; 206/143; 206/198; 206/446

[58] Field of Search ..... 206/427, 429–431, 206/503, 443, 446, 139, 143, 147, 162, 200, 192, 198, 199

[56] References Cited

U.S. PATENT DOCUMENTS

| | | | |
|---|---|---|---|
| 2,172,196 | 9/1939 | Flamm | 206/427 |
| 2,685,401 | 8/1954 | Guyer . | |
| 2,748,978 | 6/1956 | Hennessey et al. | 206/200 |
| 2,954,898 | 10/1960 | Freeberg . | |
| 3,587,910 | 6/1971 | McCarthy | 206/139 |
| 3,760,974 | 9/1973 | Oglesbee . | |
| 3,840,171 | 10/1974 | Waters | 206/427 |
| 3,868,140 | 2/1975 | Gordon | 206/427 |
| 3,923,155 | 12/1975 | Tanzer . | |
| 3,951,259 | 4/1976 | Oglesbee . | |
| 3,986,628 | 10/1976 | Prödel . | |
| 4,088,262 | 5/1978 | Kuehlhorn | 206/194 |
| 4,130,200 | 12/1978 | Iepson et al. . | |
| 4,295,345 | 10/1981 | Atkinson . | |
| 4,410,099 | 10/1983 | deLarosiere . | |
| 4,471,870 | 9/1984 | Uhlig | 206/427 |
| 4,625,864 | 12/1986 | Nigrelli . | |
| 4,895,256 | 1/1990 | Johnston | 206/503 |
| 4,911,300 | 3/1990 | Colonna . | |
| 5,249,738 | 10/1993 | Werth | 206/192 |
| 5,437,370 | 8/1995 | Marco | 206/427 |

*Primary Examiner*—Paul T. Sewell
*Assistant Examiner*—Luan K. Bui
*Attorney, Agent, or Firm*—Speckman Pauley Petersen & Fejer

[57] ABSTRACT

A paperboard container carrier having a base, a handle extending from and integral with the base, and a shroud having an opening to accommodate the handle. The base supports a plurality of containers which are separated between rows of the containers by the handle. The base preferably has an integrally formed, upwardly extending, base sidewall that extends around a periphery of the base and retains the containers. When the carrier package is assembled, the containers are retained between the base, the shroud and the sidewall. The handle extends between the containers and through the opening in the shroud. The shroud may have a downwardly extending shroud sidewall that extends about a periphery of the shroud thus unitizing a top portion of the containers. The shroud may have at least one aperture that accommodates an upper portion of any one or more of the containers. Additionally, at least one divider may be positioned between the base and the shroud thus creating at least one additional layer of containers within the package. Like the shroud, the divider has an opening to accommodate the handle through the divider.

7 Claims, 4 Drawing Sheets

CONTAINER CARRIER

This application is a continuation of copending application Ser. No. 08/668,830 filed on 24 Jun. 1996 now abandoned.

BACKGROUND OF THE INVENTION

1. Field of the Invention

This invention relates to a paperboard device for carrying and unitizing containers between a base, a shroud and a handle extending from the base, toward and through a slot in the shroud.

2. Description of Prior Art

Conventional container carriers often unitize a plurality of similarly sized containers. Conventional carriers unitize containers such as cans, bottles, jars and boxes, although other packages or containers may be unitized. Traditionally, beverage container carriers are either a thermoplastic ring carrier, a single-piece paperboard box carrier, or a single-piece paperboard basket carrier. Each of these carriers has advantages and disadvantages.

The ring carrier produces a unitized package for containers using very little material. However, the carrier has little or no advertising or promotional printing space, and some consumers perceive the thermoplastic ring construction as detrimental to the environment.

The box carrier also produces a unitized package for containers but does contain a relatively large amount of space for promotional graphics. Disadvantageously, the box carrier requires a relatively large amount of material, has an awkward cut-out handle susceptible to tearing, and usually does not display the actual containers.

The basket carrier typically comprises multiple container compartments formed with paperboard walls between each container and on the sides and bottom of the package. The basket carrier, like the box carrier, produces a unitized package for containers and contains a relatively large amount of space for promotional graphics. However, the basket carrier does not restrict movement of the containers, usually bottles, with respect to the carrier.

Freeberg, U.S. Pat. No. 2,954,898 discloses a kit for holding and transporting cosmetics. The Freeberg patent teaches a tray having an integral handle and a cover having a slot through which, when the kit is in a closed position, the handle projects. The Freeberg patent does not teach unitizing similarly sized containers, the use of a sidewall extending around a base, or a cover or divider that engages the containers.

Nigrelli, U.S. Pat. No. 4,625,864 discloses a container package assembly including an upper and a lower tray, each having a short sidewall. The Nigrelli patent does not teach a handle extending from the lower tray and through the upper tray, a divider between the upper tray and the lower tray, or an upper tray having one or more apertures and/or openings.

In view of the known prior art, there is a need for a container carrier that provides the benefits of conventional box carriers, conventional basket carriers and conventional ring carriers without the respective disadvantages.

SUMMARY OF THE INVENTION

It is one object of this invention to provide a container carrier that unitizes a plurality of containers into a single, transportable, sturdy package.

It is another object of this invention to provide a container carrier having surfaces that can display advertising and promotional graphics.

It is still another object of this invention to provide a container carrier that provides a sturdy accessible handle for carrying the package of containers.

It is yet another object of this invention to provide a container carrier that requires relatively little material per container unit.

The above and other objects of this invention are accomplished with a container carrier that according to one embodiment has a paperboard base, a handle extending from the base and a shroud having an opening to accommodate the handle. The base supports a plurality of containers which are separated between rows of the containers by the handle which is integrally formed with the base, in one preferred embodiment. An upwardly extending base sidewall preferably extends around a periphery of the base and retains the containers. With the shroud positioned with respect to the base, the containers are retained between the base and the shroud. The handle preferably extends between the containers and through the opening in the shroud. The shroud preferably has a downwardly extending shroud sidewall that extends about a periphery of the shroud thus unitizing a top portion of the containers.

According to one preferred embodiment of this invention, the shroud has at least one aperture that facilitates passage of an upper portion of any one or more of the containers.

According to another preferred embodiment of this invention, at least one divider is positioned between the base and the shroud thus creating at least one additional layer of containers within the package. Like the shroud, the divider has an opening to facilitate passage of the handle through the divider.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

According to one preferred embodiment of this invention, container carrier package 10 is a two-piece paperboard device comprising base 20 and shroud 25. The paperboard is of the same or similar composition as conventional paperboard container carriers known to those skilled in the art, such as the paperboard used with conventional beverage packages of twelve cans or six bottles. When assembled, container carrier package 10 preferably houses a plurality of similarly sized containers 15.

As used throughout this specification and in the claims, the words container, can, bottle, and/or any other suitable container known to those skilled in the art, are intended to be interchangeable.

Figure 1:
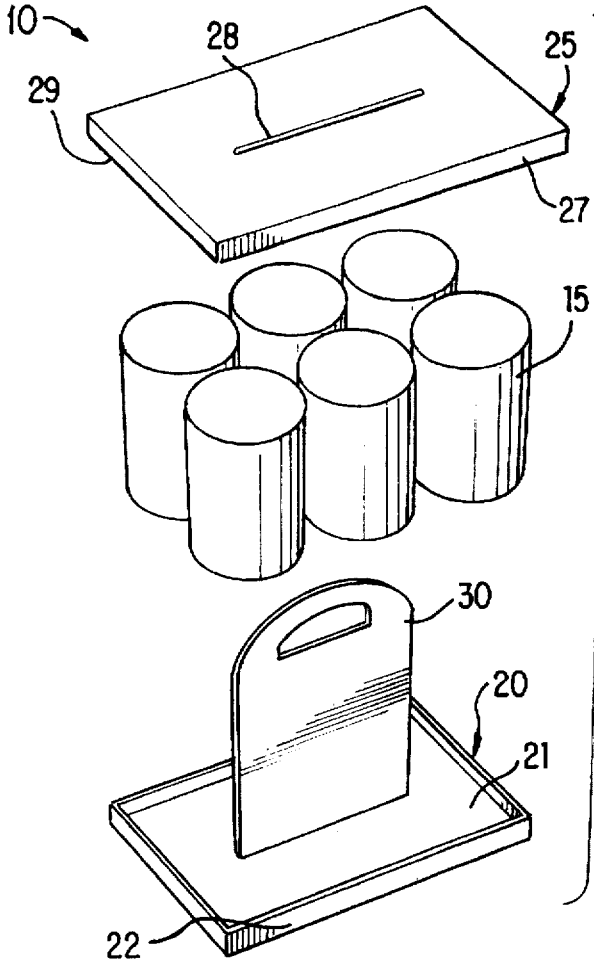
FIGS. 1–3 are diagrammatic exploded perspective views of a container carrier prior to container unitization according to different preferred embodiments of this invention.
Figure 2:
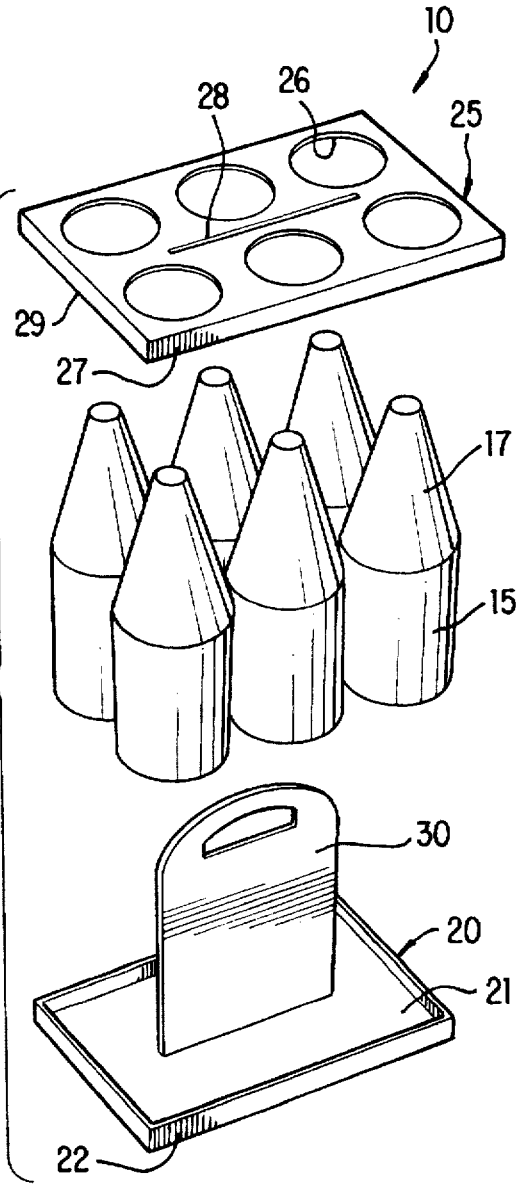
Figure 3:
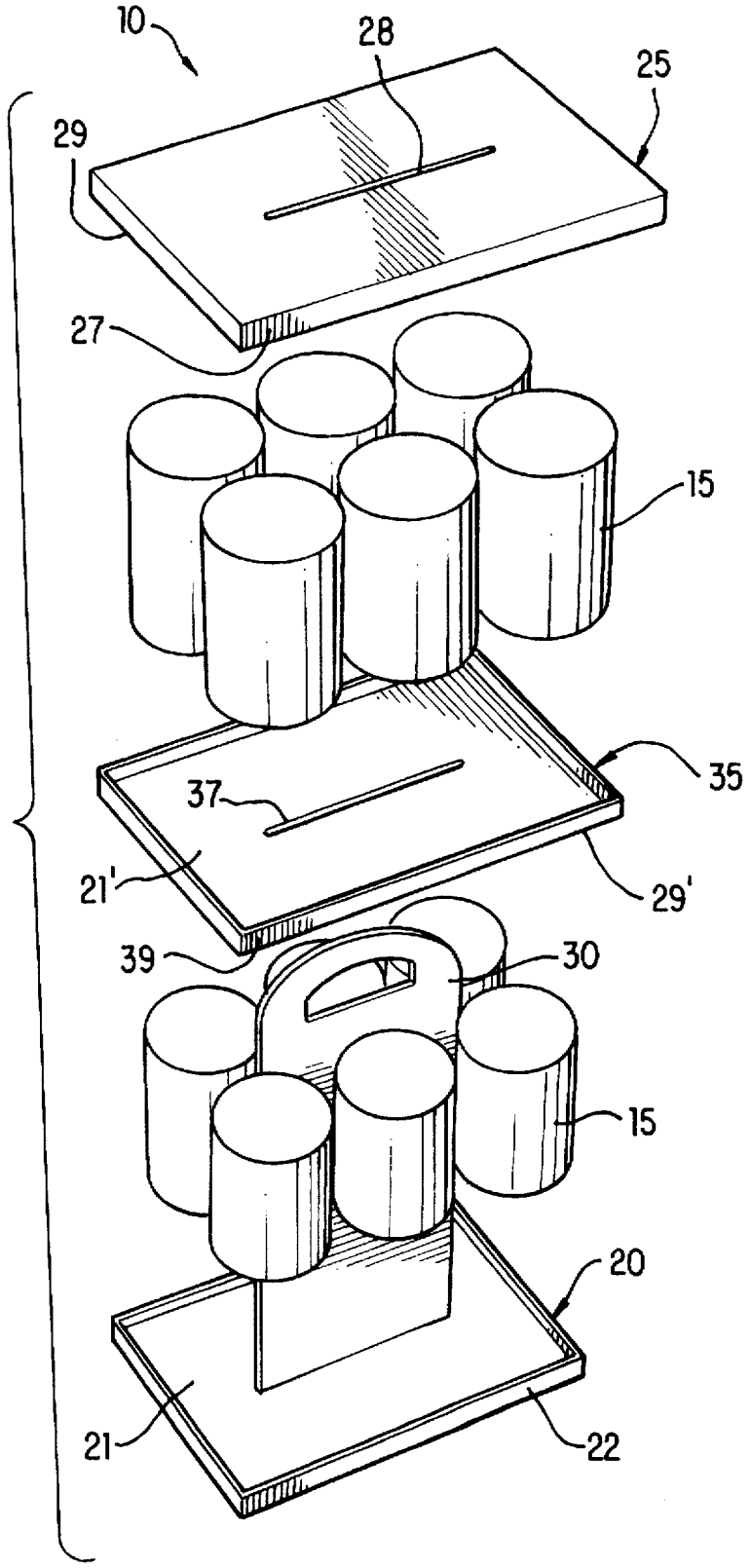
Figure 6:
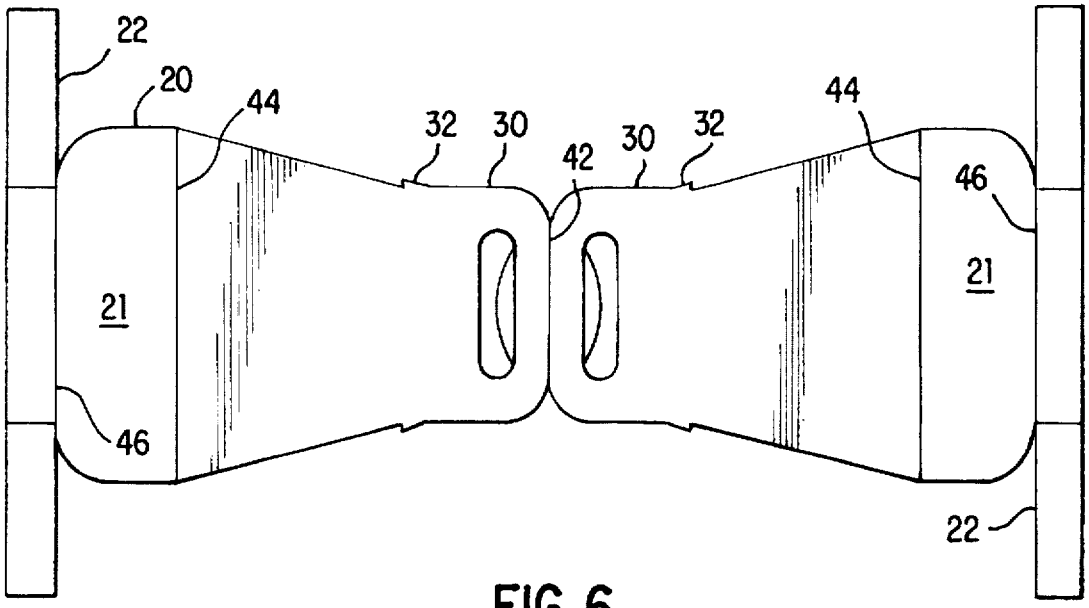
FIG. 6 shows a die-cut paperboard handle and base according to one preferred embodiment of this invention.

In one preferred embodiment of this invention, base 20 comprises support surface 21, lower sidewall 22, and handle 30. As shown in FIGS. 1–3, support surface 21 is generally planar and is sized and shaped to support a bottom surface of containers 15. It is apparent that support surface 21 could have any other suitable shape that accommodates a bottom configuration of container 15. Lower sidewall 22 is positioned around at least a portion and preferably all of a perimeter of support surface 21. Lower sidewall 22 extends upwardly from base 20 thereby forming a tray. As shown in FIG. 6, lower sidewall 22 is preferably integral with base 20 at fold line 46. When container carrier package 10 is assembled, containers 15 preferably abut an inner surface of lower sidewall 22 to retain or laterally support containers 15. Lower sidewall 22 may be sized according to the degree of lateral support required for containers 15 and the amount of printing space required on a surface of lower sidewall 22.

Handle 30 is positioned at a generally central area of support surface 21. In an assembled container carrier package 10, handle 30 is preferably positioned between adjacent rows of containers 15. In one preferred embodiment of this invention, handle 30 is integral with support surface 21. As shown in FIG. 6 in one preferred embodiment of this invention, handle 30 is integral with support surface 21 at fold line 44. Handle 30 extends upwardly, preferably perpendicular with respect to support surface 21. In one preferred embodiment of this invention, handle 30 is generally flat and of a sufficient width to support containers 15 and facilitate carrying package 10. In one preferred embodiment of this invention, shown in FIG. 6, handle 30 is formed with two plys of material connected at fold line 42. Handle 30 preferably has a length at least as long as an overall height of container 15, such that a grasping area is provided at a top portion of handle 30 for grasping access. Handle 30 may have material removed from the top portion to provide a hand grip or may have other handle means for gripping handle 30 known to those having skill in the art.

Shroud 25 is positioned with respect to base 20 and containers 15 such that when container carrier package 10 is assembled, containers 15 are retained between base 20 and shroud 25. Preferably, shroud 25 has a generally planar containing surface 29 that contacts at least a portion of a top region of containers 15. However, it is apparent that containing surface 29 could have any other suitable shape that accommodates a top configuration of container 15. Containing surface 29 may be approximately the same size as support surface 21, or, in container carrier package 10 of tapered or non-cylindrical containers 15, containing surface 29 may be smaller or larger than support surface 21. Containing surface 29 limits vertical movement of containers 15 in container carrier package 10. Shroud 25 also has opening 28 along a central section of containing surface 29, preferably in a location on containing surface 29 corresponding to the location of handle 30 on support surface 21. Preferably, opening 28 is slightly larger than a cross-section of handle 30. It is apparent that opening 28 can be a slot, as shown in FIGS. 1–3, or can be any other suitable opening that accommodates at least the top portion of handle 30. In one preferred embodiment of this invention, handle 30 having projections 32, shown in FIG. 6, extends through opening 28. Projections 32 help retain shroud 25 on container carrier package 10.

Figure 7:
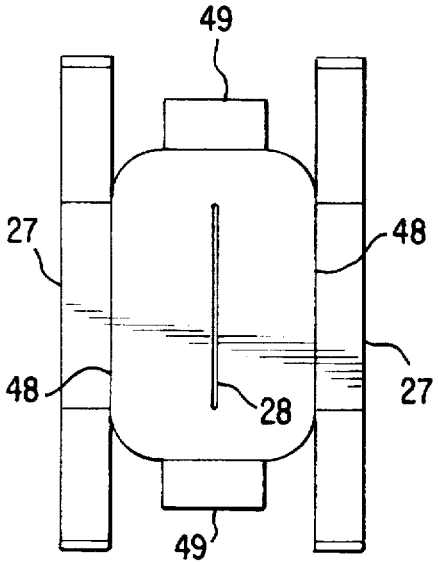
FIG. 7 shows a die-cut paperboard shroud according to one preferred embodiment of this invention.
Figure 8:
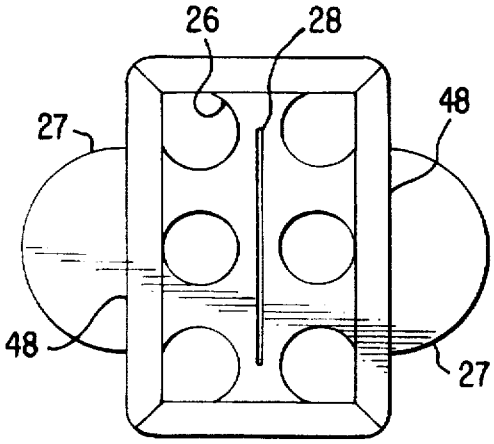
FIG. 8 shows a die-cut paperboard shroud according to another preferred embodiment of this invention.

In one preferred embodiment of this invention, shroud 25 comprises upper sidewall 27, such as a relationship between lower sidewall 22 and base 20, that extends downwardly around at least a portion and preferably all of a periphery of shroud 25 thus retaining and providing lateral support to the top region of containers 15. Like the relationship between lower sidewall 22 and base 20, upper sidewall 27 is preferably integral with shroud 25 and may be formed with shroud 25 as shown in FIGS. 7 and 8. Upper sidewall 27 is formed at fold line 48 and, in one preferred embodiment of this invention shown in FIG. 7, may be further supported by attaching tabs 49 to upper sidewall 27.

Figure 4:
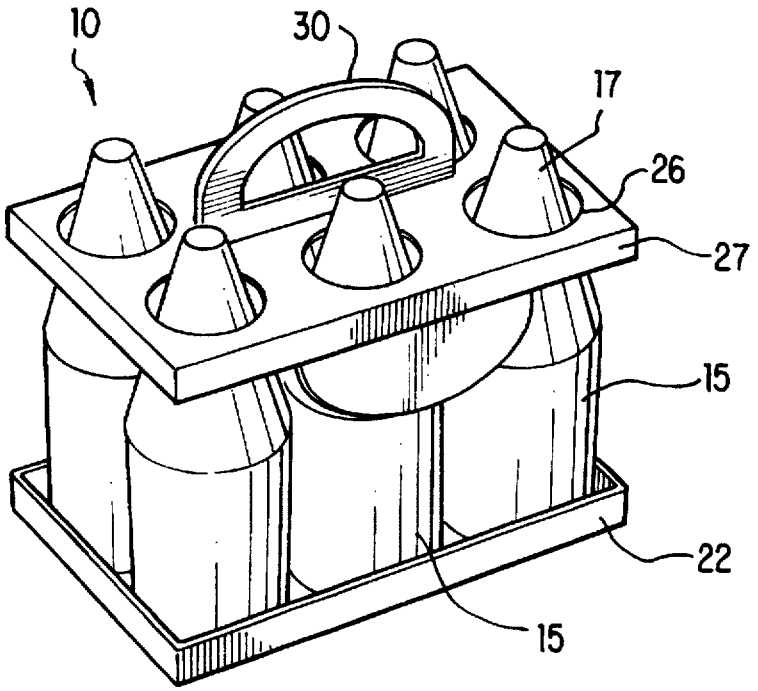
FIG. 4 shows a diagrammatic perspective view of a container carrier package according to one preferred embodiment of this invention.
Figure 5:
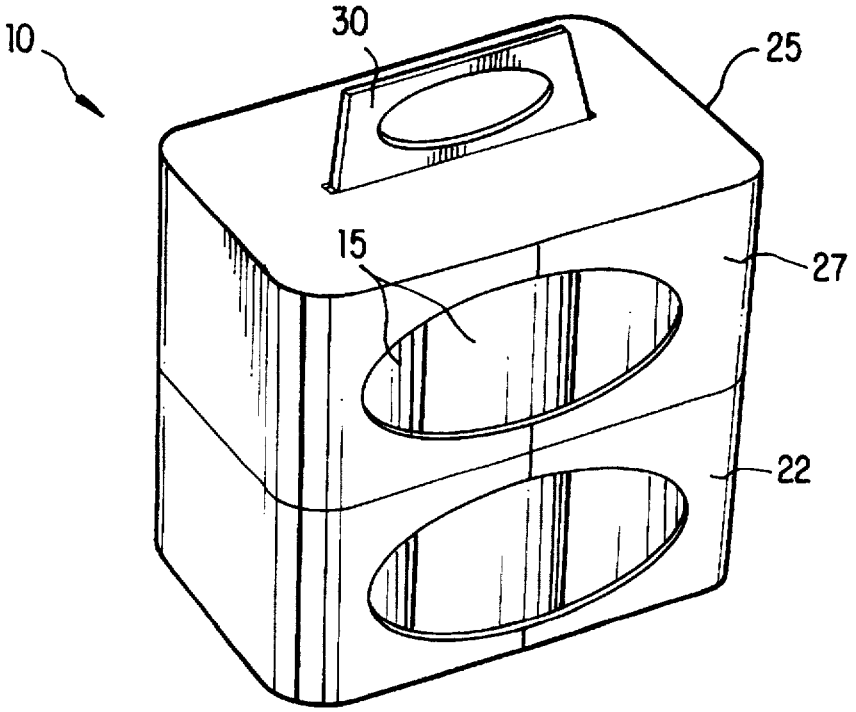
FIG. 5 shows a diagrammatic perspective view of a container carrier package according to another preferred embodiment of this invention.

In assembled container carrier package 10 as shown in FIGS. 4 and 5, handle 30 extends from between containers 15 through opening 28 in shroud 25. When an upward force is applied to handle 30, base 20 supports containers 15 and support surface 21, lower sidewall 22, upper sidewall 27, and containing surface 29 retain containers 15 within container carrier package 10.

As shown in FIGS. 2, 4 and 8, according to one preferred embodiment of this invention, shroud 25 has at least one container receiving aperture 26 that accommodates neck portion 17 of container 15, in this preferred embodiment, a bottle. Neck portion 17 of container 15 is preferably in contact with, or closely proximate to, the material of shroud 25 that defines container receiving aperture 26 to limit lateral movement of container 15 with respect to container carrier package 10.

According to another preferred embodiment of this invention, as shown in FIG. 3, at least one divider 35 positioned between base 20 and shroud 25 creates at least one additional layer of containers 15 within package 10. Like shroud 25 having opening 28, divider 35 has intermediate opening 37 to accommodate handle 30 through divider 35. Handle 30, in this preferred embodiment, is long enough to pass through each layer of containers 15 created by the addition of one or more dividers 35. Divider 35 comprises support surface 21', similar to support surface 21 of base 20, that supports an upper layer of containers 15. Additionally, divider 35 has containing surface 29', similar to containing surface 29 of shroud 25, that limits vertical movement of a lower layer of containers 15. In one preferred embodiment of this invention, containers 15 are arranged in two, as shown in FIG. 3, or more layers within container carrier package 10.

Divider 35 also preferably comprises divider sidewall 39 similar to upper sidewall 27 and lower sidewall 22 of shroud 25 and base 20, respectively. Divider sidewall 39, according to one preferred embodiment of this invention, extends both upwardly toward shroud 25 and downwardly toward base 20. Divider sidewall 39 is preferably integral with divider 35. Divider sidewall 39 helps retain containers 15 within container carrier package 10.

According to one preferred embodiment of this invention, lower sidewall 22, upper sidewall 27, and, in an additional embodiment, divider sidewall 39, may together extend for the complete length of one or more levels of cans. Additionally, sidewalls 22 and 27, as shown in FIG. 5, may have cutouts or material removed to form a window for visibility of containers 15 or to provide customized container carrier package 10 design.

Divider 35 configuration may also be used with shroud 25 having container receiving apertures 26. In such preferred embodiment of this invention, divider 35 does not provide direct support for the top layer of containers 15, but instead a top surface of containers 15 on the lower layer of package 10 provide support for a bottom surface of containers 15 on the top layer of package 10.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A paperboard carrier assembly for carrying a plurality of similarly sized containers as a unitized package, the assembly comprising:

a base having a generally planar support surface;

a shroud positioned generally opposite and separate from the base, the shroud having an opening;

a lower sidewall positioned at least partially about a base periphery of the base and integral with the base, the lower sidewall extending toward the shroud; and a handle integrally formed with the base, the handle projecting from the base and extending toward the shroud and through the opening, and the handle traversing at least partially across the support surface so that in an assembled carrier assembly the handle is positioned between the containers.

2. An assembly according to claim 1 further comprising an upper sidewall positioned at least partially about a shroud periphery of the shroud and attached with respect to the shroud.

3. An assembly according to claim 2 wherein the upper sidewall is at least partially integral with the shroud.

4. An assembly according to claim 1 wherein the shroud has at least one container receiving aperture.

5. An assembly according to claim 1 wherein the handle extends beyond the shroud.

6. An assembly according to claim 1 further comprising at least one paperboard divider positioned between the base and the shroud, and the divider having an intermediate opening.

7. An assembly according to claim 6 further comprising a divider sidewall positioned at least partially about a divider periphery of the divider and attached with respect to the divider.

* * * * *